United States Patent [19]

Hipple

[11] Patent Number: 4,519,113

[45] Date of Patent: May 28, 1985

[54] TRANSFORMING THE UPRIGHT VACUUM CLEANER'S OWN PUSH-PULL HANDLE INTO A SUCTION CLEANING WAND

[76] Inventor: Robert J. Hipple, 2005 E. Maryland Ave., St. Paul, Minn. 55119

[21] Appl. No.: 394,859

[22] Filed: Jul. 2, 1982

[51] Int. Cl.[3] ..... A47L 5/32

[52] U.S. Cl. ..... 15/335; 15/410

[58] Field of Search ..... 15/335, 350, 351, 336, 15/410, 334

[56] References Cited

U.S. PATENT DOCUMENTS

| | | | |
|---|---|---|---|
| 1,936,761 | 11/1933 | Hoover | 15/334 |
| 2,175,644 | 10/1939 | Replogle | 15/336 |
| 2,210,950 | 8/1940 | Replogle | 15/335 X |
| 2,266,075 | 12/1941 | Replogle | 15/335 |
| 2,898,621 | 8/1959 | Vance | 15/334 X |
| 4,171,553 | 10/1979 | Stein | 15/335 X |

FOREIGN PATENT DOCUMENTS

| | | | |
|---|---|---|---|
| EP39437 | 11/1981 | European Pat. Off. | 15/410 |
| 1208457 | 1/1966 | Fed. Rep. of Germany | 15/334 |

*Primary Examiner*—Chris K. Moore

[57] ABSTRACT

An upright vacuum cleaner having a tubular push-pull handle of one or more separable sections, this push-pull handle is detachable at its base end from the upright vacuum cleaner and the opposite end of the push-pull handle is connected to the vacuum cleaner's suction power system by means of a flexible hose. When the vacuum cleaner's suction power is supplied to the hose and the push-pull handle is detached at its base end, the push-pull handle now becomes an immediate suction cleaning wand. This invention eliminates the need for a separate flexible hose kit. The housing on this vacuum cleaner is slightly larger than on previous machines. The housing opens up to receive the dust filter which formerly was external.

1 Claim, 2 Drawing Figures

TRANSFORMING THE UPRIGHT VACUUM CLEANER'S OWN PUSH-PULL HANDLE INTO A SUCTION CLEANING WAND

BACKGROUND OF THE INVENTION

This invention relates to the upright vacuum cleaner. The upright vacuum cleaner is mounted on wheels or rollers. It vacuums the dirt from carpets by means of a suction opening on its bottom. The dirt is then blown into an external filter which is attached to the rear of the machine. The upright vacuum cleaner is easily maneuvered about the carpet by means of a permanently attached push-pull tubular handle.

The disadvantage of the upright vacuum cleaner is that it must have a separate kit of attachments to use when cleaning furniture, draperies, stairways, under beds and other hard to get at places. This kit consists of a flexible hose and snap-on cleaning heads and brushes. This hose must be plugged into the vacuum cleaner's suction system and thus becomes a suction cleaning wand. Obviously it is inconvenient to get the kit from its storage place and attach it to the machine. Furthermore, the upright vacuum cleaner becomes a very cumbersome machine when the hose is attached.

SUMMARY

The object of my invention, therefore, is to transform the upright vacuum cleaner's own push-pull tubular handle into a suction cleaning wand. This is accomplished by having the handle detachable at its base end and connected to the vacuum cleaner's suction system at the other end by means of a flexible hose.

DETAILED DESCRIPTION OF THE INVENTION

Figure 1:
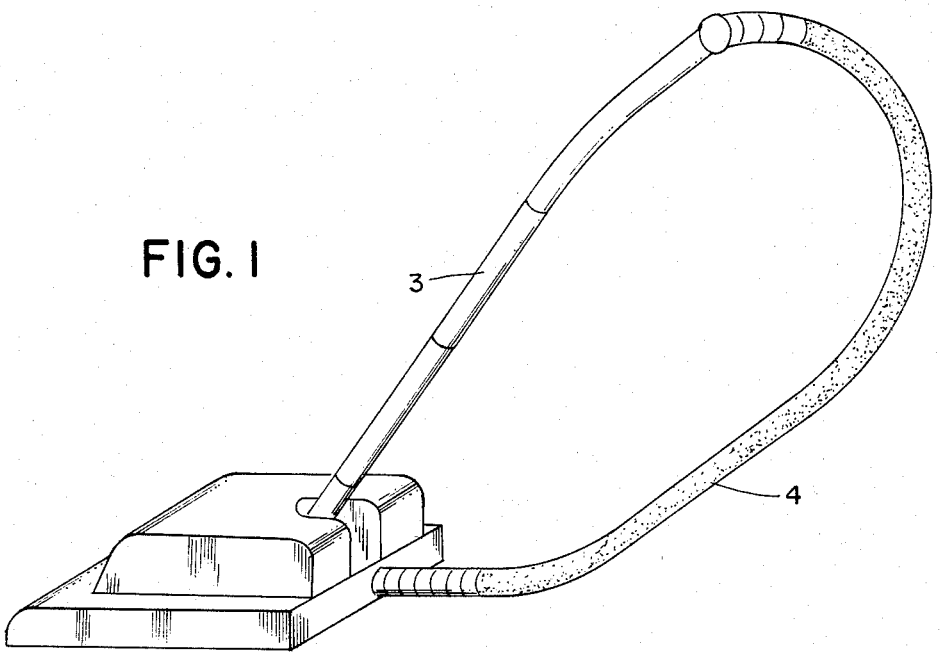
FIG. 1 shows the push-pull handle attached to the vacuum cleaner as when vacuuming carpets.

FIG. 1 shows the upright vacuum cleaner now having a slightly larger housing than on previous upright vacuum cleaners. This housing opens up to receive the dust filter. This filter formerly was external and was attached to the rear of the vacuum cleaner. The drawing shows the push-pull tubular handle (3) attached to the machine as used when cleaning carpets. This tubular handle consists of one or more separable sections. The tubular push-pull handle is detachable at its base end and connected at its other end to the vacuum cleaner's suction system by means of a flexible hose (4). The push-pull handle becomes an immediate suction cleaning wamd when it is detached at its base end from its airtight socket assembly. Obviously the socket assembly need not be airtight and power from the suction system can be supplied to that flexible hose by valves or other means. It must also be noted the suction power of the handle can be greatly increased by cutting off the suction power of the rug cleaning opening on the bottom of the machine by means of a cap or an air valve.

Figure 2:
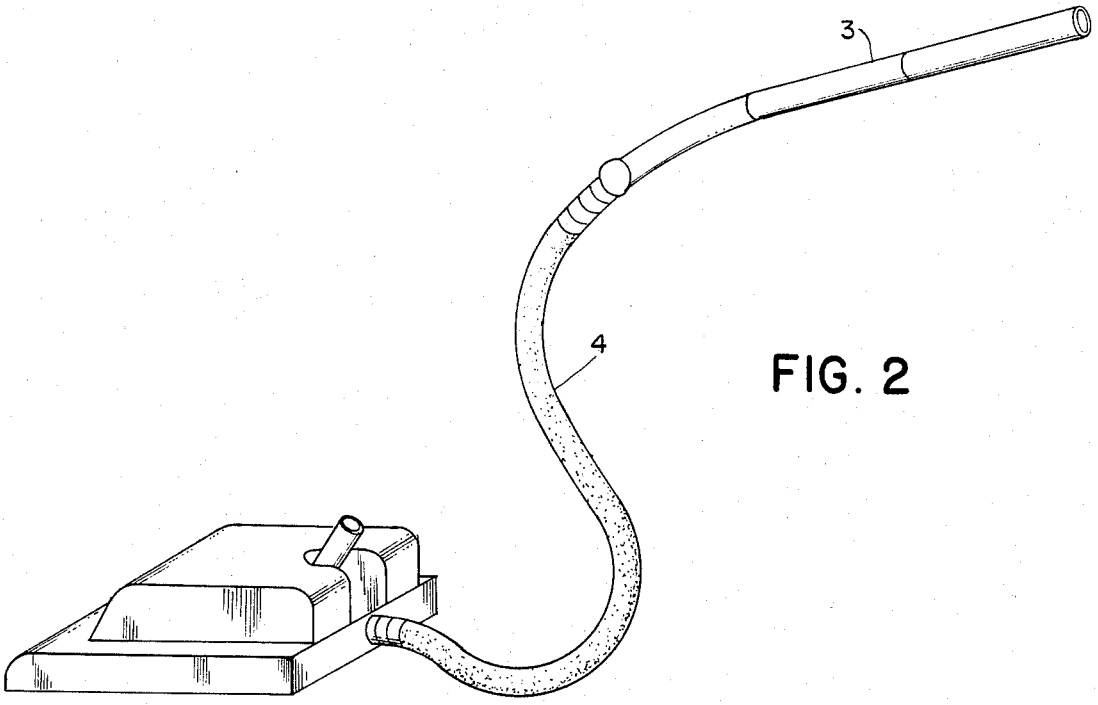
FIG. 2 shows the push-pull handle detached at its base end, thus becoming a suction cleaning wand.

FIG. 2 shows the push-pull handle (3) detached at its base end and now being used as a suction cleaning wand. Cleaning heads or brushes can be snapped onto the end of the suction cleaning wand.

I claim:

1. An upright vacuum cleaner having a tubular push-pull handle consisting of one or more hand-separable sections, said push-pull handle being hand-detachable at its base end from an air-tight socket assembly which is affixed to said vacuum cleaner and the opposite end of said push-pull handle being attached to one end of a flexible hose and the other end of said flexible hose leads to and has access to said vacuum cleaner's suction power system, said flexible hose combined with the tubing of said push-pull handle thus being the means of transferring said suction power of said vacuum cleaner to the detached base of said push-pull handle and thereby transforming said push-pull handle into a suction cleaning wand with the length of said cleaning wand being determined by the number of sections left attached to said flexible hose.

* * * * *